United States Patent [19]

Zorini

[11] Patent Number: 4,841,750

[45] Date of Patent: Jun. 27, 1989

[54] CONTROL MEMBER FOR THREADING TUBE LIFTERS IN CROCHET GALLOON LOOMS

[75] Inventor: Luigi O. Zorini, Cilavegna, Italy

[73] Assignee: Comez, S.P.A., Cilavegna, Italy

[21] Appl. No.: 222,945

[22] Filed: Jul. 22, 1988

[30] Foreign Application Priority Data

Jul. 31, 1987 [IT] Italy ..... 21542 A/87

[51] Int. Cl.[4] ..... D04B 23/00

[52] U.S. Cl. ..... 66/204; 66/205; 66/207

[58] Field of Search ..... 66/203, 205, 204, 207, 66/214

[56] References Cited

U.S. PATENT DOCUMENTS

| | | | |
|---|---|---|---|
| 4,448,046 | 5/1984 | Mista et al. | 66/205 |
| 4,448,047 | 5/1984 | Romano | 66/207 |
| 4,549,414 | 10/1985 | Zorini et al. | 66/203 |
| 4,581,905 | 4/1986 | Bonaschi | 66/203 |
| 4,590,776 | 5/1986 | Bonaschi | 66/205 |

FOREIGN PATENT DOCUMENTS 657162 8/1986 Switzerland .

*Primary Examiner*—Ronald Feldbaum

*Attorney, Agent, or Firm*—Laff, Whitesel, Conte & Saret

[57] ABSTRACT

The control member herein described comprises an electromagnet 30 which is fixed with respect to a thread guide rail and acts on a swinging arm 37 l pivoted with respect to the electromagnet itself and slidably engaging a lifter 14. Due to the energization of the electromagnet 30 the swinging arm 37, is brought, against the action of a return spring 39, from a rest position in which the lifter is disposed in a disengagement condition, to a working position in which the lifter is in an engagement condition and is engaged by actuator means oscillating in synchronism with the thread guide rail in order to cause the actuation of a threading tube associated with said lifter.

8 Claims, 3 Drawing Sheets

18
16
19
14
17
20
28
18
16
14b
19
27
50
37
24
2a
49
14a
2b
13
22
23
14
26
21
1
25
2a
2
36
15
14a
12a
2b
13
3
4
4
12
12
11
11
10
5
6
7

16
19
18
14b
20
17
14

16
18
19
14
17
20
14b

CONTROL MEMBER FOR THREADING TUBE LIFTERS IN CROCHET GALLOON LOOMS

BACKGROUND OF THE INVENTION

1. Field of the Invention

The present invention relates to a control member for threading tube lifters in crocket galloon looms, of the type comprising an electromagnet which is fixed with respect to a thread guide rail and associated with at least a lifter oscillatably engaged in relation to said thread guide rail, said electromagnet being energizable to bring the lifter from a disengagement condition in which the latter keeps a fixed positioning with respect to the thread guide rail, to an engagement condition in which it can be engaged by actuator means giving it an oscillating motion in synchronism with the oscillating motions performed by the thread guide rail.

The present control member particularly lends itself to be used on crocket galloon looms provided with a jacquard device, but it can also be applied to needle looms to make ribbons as welll as to traditional and dobby looms.

2. Prior Art

It is known that in crocket galloon looms provided with a jacquard device each weft yarn is engaged through a threading tube oscillatably supported by a thread guide rail which in turn is oscillatably movable in synchronism with the needle movements. Each threading tube can be selectively operated, upon command of the jacquard device, so that it performs suitable oscillations with respect to the thread guide rail causing the respective weft yarn to be selectively engaged or not by one or more needles during each working cycle.

By selectively operating the threading tubes during each working cycle, the jacquard device is capable of controlling the positioning of the single weft yarns so as to produce very elaborate figured fabrics.

Operation of the threading tubes is carried out through control lifters connected thereto by means of cables guided along respective sheaths. Lifters are individually operable upon command of selector means being part of the jacquard device.

In modern technical solutions lifters are connected to the thread guide rail along which they are distributed in an upright position, each of them being located over the respective threading tube. Also associated with the thread guide rail is actuator means provided with an oscillatory motion in a vertical direction, which motion is added to the oscillations performed by the thread guide rail.

Associated with each filter is an electromagnet which, upon command of an electronic control unit suitably programmed, is capable, if necessary, of positioning the lifter so that it may be engaged by the actuator means and involved in the oscillatory motion thereof in order to operate the respective threading tube.

Generally when the corresponding magnet is deenergized, the lifter is disposed in a disengagement condition and it is only subjected, together with the respective threading tube, to the horizontal and vertical oscillations of the thread guide rail as it is not engaged by the actuator means. When the electromagnet is energized, the lifter is slightly shifted with respect to the previously taken position and is disposed in an engagement condition. Under this situation the lifter can be engaged by the actuator means in the region of an end projection thereof, so that it can be vertically translated against the action of a return spring and can cause an oscillation of the respective threading tube with respect to the thread guide rail during each working cycle that it performs in this condition.

Presently each lifter is guided during the vertical translations it receives from the actuator means, by one or more guide elements which are fixed with respect to the thread guide rail. The displacements of the lifter from a disengagement condition to an engagement condition usually take place as a result of the elastic deformation of the lifter itself under the effect of the magnetic field created by the energized electromagnet. When the electromagnet energization ceases the lifter, due to its elastic return, is automatically arranged in its disengagement condition.

However the above described solutions are not reliable in the long run as regards the correct operation of the lifter.

This is partly due the fact that when the lifter is in its engagement condition it is elastically deformed and exerts a stress on the corresponding guide element. Under this situation the guide element can be rapidly worn due to the slidings of the lifter as a result of its vertical oscillations.

Reliability in operation is also impaired by the fact that lifters must be operated using very small electromagnets in order to achieve a reduced bulkiness. When after a prolonged use of the knitting machine dust and other impurities have laid down on the electromagnets, the magnetic field they produce may become too weak and therefore unable to bring about the elastic deformation of the corresponding lifters.

SUMMARY OF THE INVENTION

The main object of the present invention is to eliminate the above mentioned drawbacks and provide a control member adapted to shift the respective lifter from a disengagement condition to an engagement condition without involving any elastic deformation of the latter and also capable of exerting a guide function on the lifter in its engagement condition.

The foregoing and further objects which will become more apparent in the course of the following description are substantially attained by a control member for threading tube lifters in crochet galloon looms which further comprises a swinging arm rotatably pivoted with respect to said electromagnet and provided with a guide element slidably engaging said lifter, said swinging arm being translatable, due to the energization of said electromagnet and against the action of at least a return spring, from a rest position corresponding to the disengagement condition of the lifter, to a working position in which the lifter is in its engagement condition.

BRIEF EXPLANATION OF THE DRAWINGS

Further features and advantages will best be understood from the detailed description of a preferred embodiment of a control member for threading tube lifters in crocket galloon looms in accordance with the present invention, given hereinafter by way of non limiting example with reference to the accompanying drawings, in which.

DESCRIPTION OF THE PREFERRED EMBODIMENT

Figures 1, 1A, 1B:
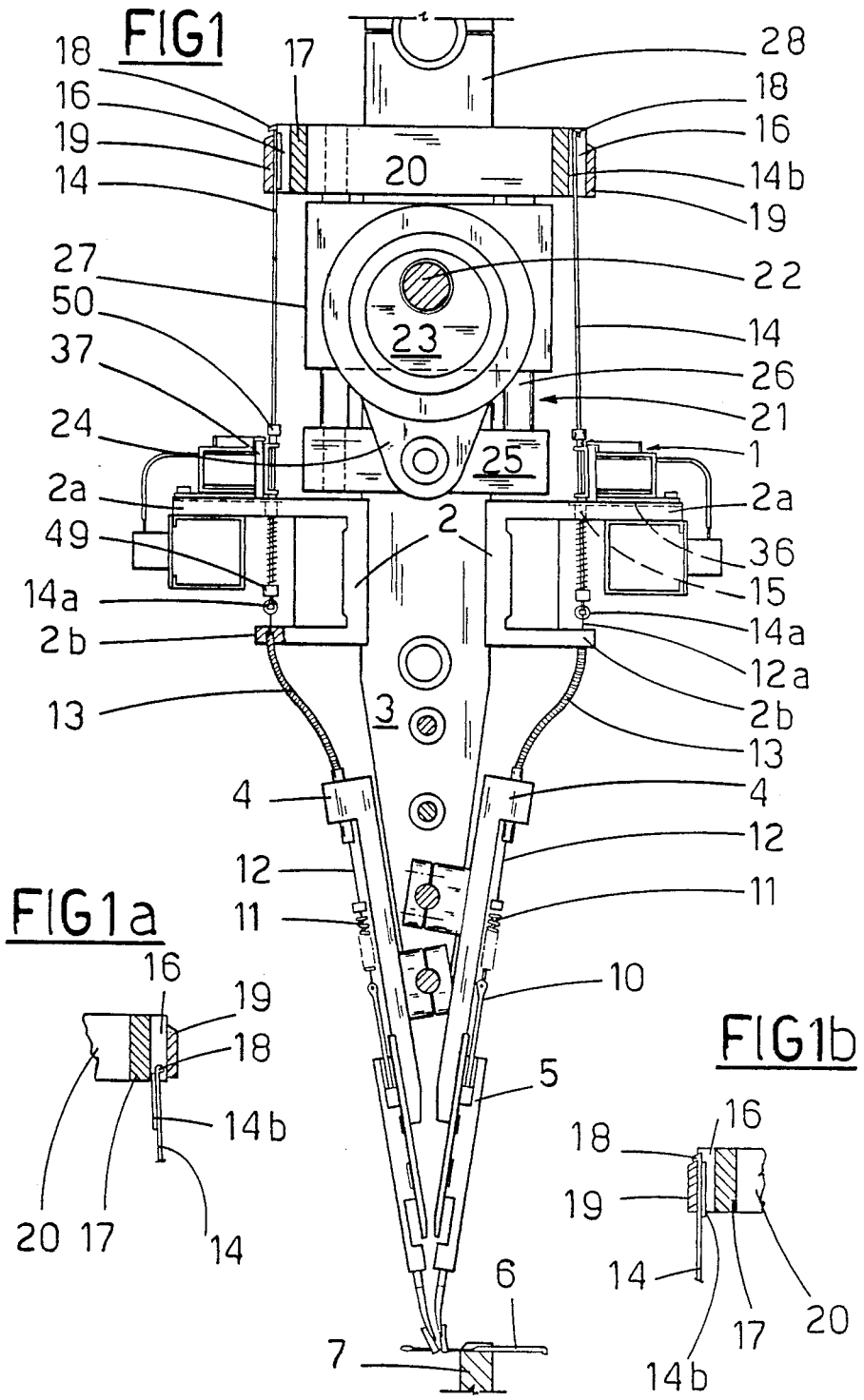
FIG. 1 is a diagrammatic side view of a control device for threading tubes having the control members of the present invention associated therewith.
FIG. 1*a* shows the relative positioning between a coupling knife included in the actuator means and when said actuator means is at the upper dead center of its stroke, and a lifter in its disengagement condition.
FIG. 1*b* shows the relative positioning between a coupling knife included in the actuator means and when said actuator means is at the upper dead center of its stroke, and a lifter in its engagement condition.
Figure 2:
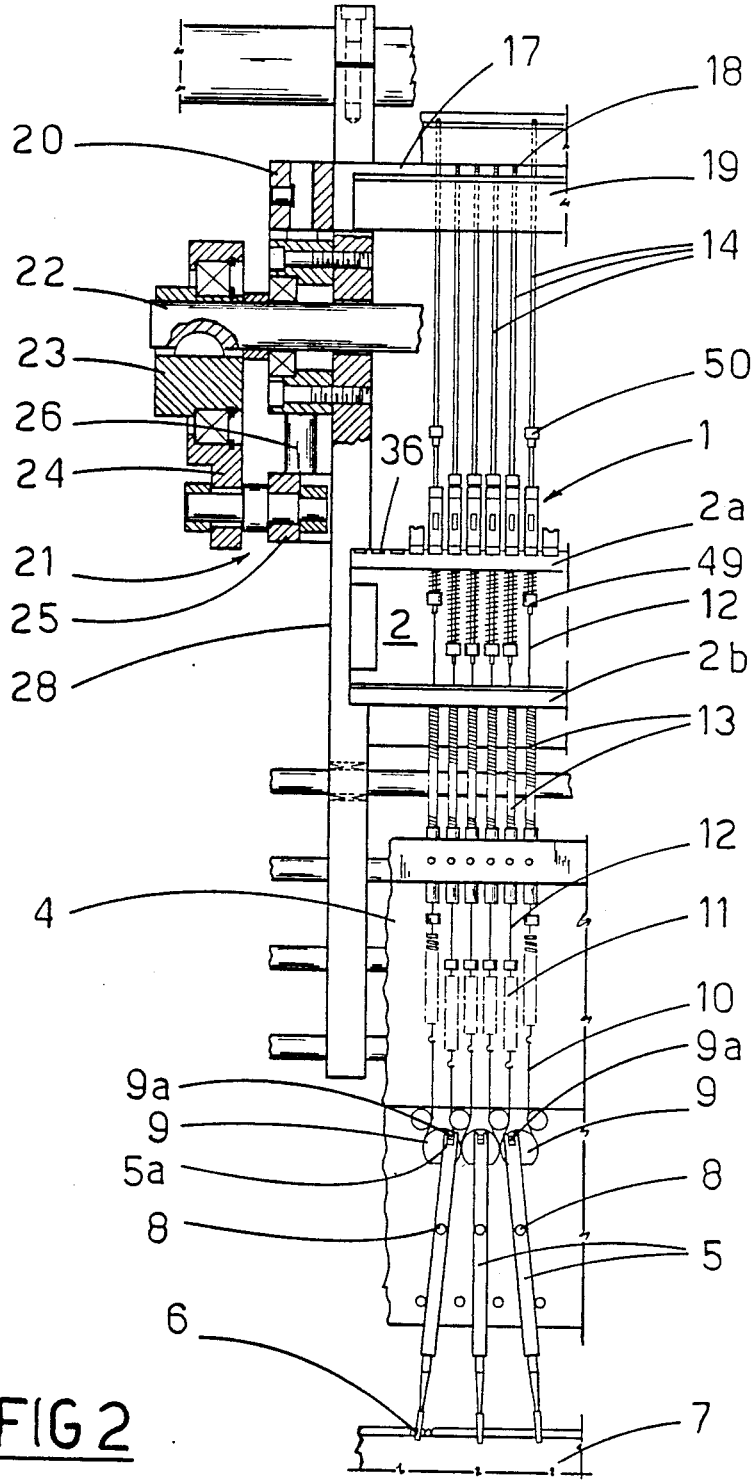
FIG. 2 is a broken diagrammatic front view of the device shown in FIG. 1.

With reference to the drawings, a control member for threading tubes in crocket galloon looms in accordance with the present invention has been globally identified by reference numeral 1.

In a crochet galloon loom provision is made for a number of said control members 1 conventionally distributed according to a mutual side-by-side disposition, along upper limbs 2*a* exhibited by respective C-shaped support bars 2 fastened on either side to a thread guide rail 3.

Fixedly connected to a lower part of the thread guide rail 3, on either side thereof, are two plates 4, a number of threading tubes 5 mutually disposed in a side-by-side relationship being mounted on each of said plates.

In operation the thread guide rail 3 oscillates according to a combination of horizontal and vertical movements so that each threading tube 5 travels over a path which is astride of at least a respective needle 6 supported by a needle bar 7 and provided with an oscillatory motion along its own axis.

In known manner, in the example shown each threading tube 5 is pivoted at 8 on the corresponding plate 4 and can oscillate about its own pivoting axis upon command of a roller 9 provided with an eccentric pivot 9*a* engaging an upper end 5*a* of the threading tube. Roller 9 receives an angular rotation by a pair of tie rods 10 each of which is connected to an actuation cable 12 slidably guided within a respective sheath 13, spring means 11 being interposed therebetween. Sheath 13 extends between the corresponding plate 4 and a lower limb 2*b* exhibited by the support bar 2.

Each actuation cable 12 has an upper hooked end 12*a* slidably crossing the lower limb 2*b* and being then connected to the lower end 14a of a lifter 14.

Lifter 14 extends in a substantially vertical direction slidably and loosely crossing the upper limb 2a by means of a through opening 15 formed in the latter and it has an upper end 14*b* slidably engaged in a recess 16 formed in a lift bar 17. Lifter 14 is further provided with a hooking lug 18 projecting from the upper end 14b thereof and designed to be engaged by a coupling knife 19 secured to the lifting bar 17.

In known manner the lifting bars 17 which are each associated with lifters 14 for the control of the threading tubes 5 mounted on one of said plates 4, are connected to each other by crosspieces 20 acted upon by actuator means globally identified by 21 and supported by the thread guide rail 3.

Actuator means 21 imparts an oscillatory motion in a vertical direction to the lifting bars 17 and therefore the coupling knifes 19, which oscillatory motion is added to the oscillatory motion performed by the thread guide rail 3. To this end, in known manner actuator means 21 comprises a rotating shaft 22 provided at the opposed ends thereof (only one of which is shown in the drawings), with eccentrics 23 acting on respective connecting rods 24. Each connecting rod 24 is connected to a bracket 25 from which two columns 26 vertically extend. Columns 26 slidably pass through a guide element 27 integral to a fixed framework 28 and are connected to the crosspiece 20 to transmit the latter the oscillatory motion imparted to bracket 25 by the connecting rod 24.

Figure 3:
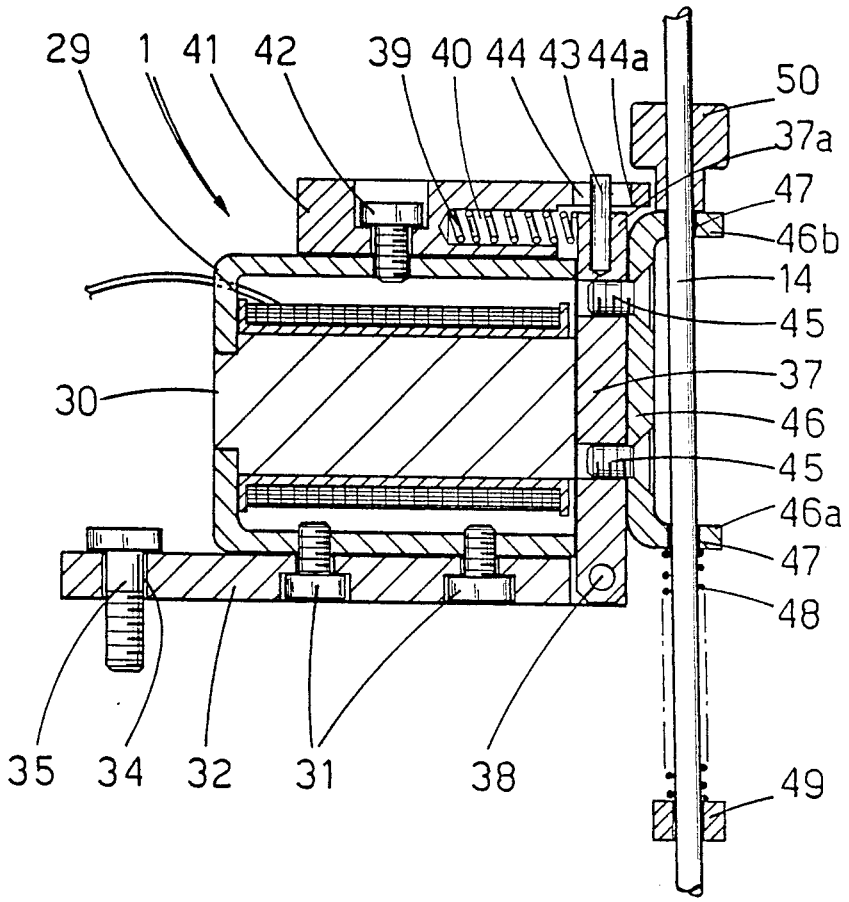
FIG. 3 is a cross-sectional view on an enlarged scale of the control member in accordance with the invention.

In accordance with the present invention each control member 1 associated with one of said lifters 14 comprises, as shown in FIG. 3, a box-shaped envelope 29 accommodating an electromagnet 30 electrically connected to an electronic control unit not shown as known per se. The box-shaped envelope 29 is made integral by screw threaded members 31 to a fastening plate 32 provided with a through hole 34 adapted to engage it by means of screws 35 or the like, in a housing 36 matching the shape of said plate and formed in the upper limb 2*a*.

The control member 1 further comprises a swinging arm 37 rotatably engaged by a pivot 38 to the fastening plate 32 and extending in front of the electromagnet 30. Acting on a free end 37*a* of the swinging arm 37 is a return spring 39 urging the swinging arm away from the electromagnet 30.

Spring 39 is accommodated in a housing 40 formed in a block 41 secured by means of a theaded member 42 to the box-shaped envelope 29 on its side opposite that facing the fastening plate 32. Furthermore, a stop pin 43 is engaged to the free end 37*a* and it extends through a slot 44 formed in a projecting portion of block 42. Pin 43 is designed to come in abutment against one end 44a of the slot 44 when the electromagnet 30 is deenergized and the return spring 39 pushes the swinging arm 30 away thereform.

Fastened to arm 37 by means of screws 45 is a guide element 46 provided with two bent ends 46*a* and 46*b* in which respective through holes 47 in coaxial relation are formed. Holes 47 are designed to slidably engage the corresponding lifter 14 in order to guide it while it performs vertical oscillations upon the action of actuator means 21. Said vertical oscillations take place against the action of a return spring 48 wound on lifter 14 and acting between a locating element 49 disposed on the lifter itself and the lower bent end 46a.

Operation of the control member according to the invention described above mainly as regards structure, is as follows.

When the electromagnet 30 is deenergized, as is the case with the control member 1 viewed to the right, upon the action of spring 39 the swinging arm 37 is held in a rest position due to the abutment of the stop pin 43 against the end 44*a* of slot 44. When the arm 37 is in its rest position, the corresponding lifter 14 is maintained in a disengagement condition and thus its upper end 14*b* is slighlty spaced apart from the coupling knife 19 in the interior of recess 16. In this manner lifter 14 is not subjected to be involved in the oscillations of actuation means 21 since the coupling knife 19 during its upstroke is unable to engaged the lifter lug 18. Therefore lifter 14 maintains a fixed position with respect to the thread guide rail 3, which position results from the abutment between a stop element 50 disposed on the lifter itself and the upper bent end 46b.

When the electromagnet 30 is energized upon command of the above mentioned control unit, as is the case with the control member viewed to the left in FIG. 1 and the control member shown in FIG. 3, the swinging arm 37 is attracted towards the electromagnet and brought to an operating position in which it is in abutment against the edges of the box-shaped envelope 29. Under this situation the corresponding lifter 14 is moved from the above described disengagement condition to an engagement condition in which its upper end 14*b* inside the recess 16 is translated towards the coupling knife 19. Therefore lifter 14 can be engaged in the region of its hooking lug 18 by the coupling knife 19 being thus involved in the vertical oscillations caused by the actuator means 21 (FIG. 1*b*).

Under this situation lifter 14 is subjected to perform a vertical translation with respect to the thread guide rail 3 during each working cycle, which translation in known manner brings about a corresponding oscillation of the threading tube 5 connected thereto.

When the energization of the electromagnet 30 ceases, the swinging arm 37 is brought again to its rest position upon the action of spring 39 and, as a result, lifter 14 is again disposed in its disengagement condition.

The present invention attains the intended purposes.

In fact the present control member appears adapted to guide the associated lifter during its vertical oscillations with respect to the thread guide rail and bring the lifter from its disengagement position to its engagement position and vice versa without involving any elastic deformation of the lifter itself.

Thanks to these qualities, the control member in accordance with the invention eliminates the problems connected with the reliability in use of known devices. In fact, even in the presence of dust or other impurities on the electromagnet 30 and swinging arm 37, the magnetic field produced by the energization of said electromagnet is capable of causing the lifter shifting as to this end it is no longer necessary to apply strong forces in order to achieve the elastic deformation of the lifter itself. In addition, since lifter 14 is not submitted to elastic stresses when it is in its engagement condition, it can freely slide through the guide element 46 without wearing it too much.

Obviously the present invention is susceptible of many modifications and variations, all falling within the inventive idea characterizing it.

What is claimed is:

1. A control member for threading tube lifters in crochet galloon looms, comprising an electromagnet which is fixed with respect to a thread guide rail and associated with at least a lifter oscillatably engaged in relation to said thread guide rail, said electromagnet being energizable to bring the lifter from a disengagement condition in which the latter keeps a fixed positioning with respect to the thread guide rail, to an engagement condition in which it can be engaged by actuator means giving it an oscillating motion in synchronism with the oscillating motions performed by the thread guide rail wherein said control member further comprises a swing arm rotatably pivoted with respect to said electromagnet and provided with a guide element slidably engaging said lifter, said swinging arm being translatable, due to the energization of said electromagnet and against the action of at least a return spring, from a rest position corresponding to the disengagement condition of the lifter to a working position in which the lifter is in its engagement condition.

2. The control member as claimed in claim 1, wherein said swing arm is pivoted on a fastening plate fixedly supporting the electromagnet and fixedly connected to the thread guide rail.

3. The control member as claimed in claim 1, further comprising a guide element secured to the swinging arm and provided with at least a hole through which said lifter is slidably guided.

4. The control member as claimed in claim 1, wherein the positioning of the swinging arm in its rest position is given by a stop pin fastened to the swinging arm and acting in abutment against one end of a slot formed in a block which is fixed with respect to the electromagnet.

5. The control member as claimed in claim 1, wherein said return spring is accommodated in a housing formed in said block.

6. The control member as claimed in claim 2, wherein said return spring is accommodated in a housing formed in said block.

7. The control member as claimed in claim 3, wherein said return spring is accommodated in a housing formed in said block.

8. The control member as claimed in claim 4, wherein said return spring is accommodated in a housing formed in said block.

* * * * *